US006479924B1

(12) United States Patent
Yoo

(10) Patent No.: US 6,479,924 B1
(45) Date of Patent: Nov. 12, 2002

(54) FERROELECTRIC EMITTER

(75) Inventor: In-Kyeong Yoo, Yongin (KR)

(73) Assignees: Samsung Electronics Co., Ltd., Kyungki-do (KR); Virginia Tech Intellectual Properties, Inc., Blacksburg, VA (US)

( * ) Notice: Subject to any disclaimer, the term of this patent is extended or adjusted under 35 U.S.C. 154(b) by 278 days.

(21) Appl. No.: 09/636,634

(22) Filed: Aug. 11, 2000

(51) Int. Cl.[7] ..... H01J 21/00; H01J 29/00

(52) U.S. Cl. ..... 313/310; 313/495; 313/311; 313/309; 313/351

(58) Field of Search ..... 313/495, 497, 313/310, 311, 309, 336, 351

(56) References Cited

U.S. PATENT DOCUMENTS 6,028,322 A * 2/2000 Moradi ..... 313/310

6,359,383 B1 * 3/2002 Chuang et al. ..... 313/495 X

* cited by examiner

*Primary Examiner*—Ashok Patel
(74) *Attorney, Agent, or Firm*—Lee & Sterba, P.C.

(57) ABSTRACT

A ferroelectric emitter is described. The ferroelectric emitter of the present invention includes a ferroelectric layer having a first side, an opposing second side, and a top surface, a first and a second electrode formed along the top surface of the ferroelectric layer, and a mask layer which has a predetermined pattern and is formed along the top surface of the ferroelectric layer between the first and second electrodes. When used in ferroelectric switching emission lithography, the ferroelectric emitter of the present invention allows electron emission from a wide or narrow gap of a mask layer and from an isolated pattern such as a doughnut shape while facilitating re-poling in pyroelectric electron emission.

6 Claims, 2 Drawing Sheets

FERROELECTRIC EMITTER

BACKGROUND OF THE INVENTION

1. Field of the Invention

The present invention relates to a ferroelectric emitter. More specifically, the present invention relates to a side electrode emitter in which electrodes are attached to the top surface or at side edges of a ferroelectric layer.

2. Description of the Related Art

Ferroelectric emission by switching allows for a simple process in electron emission lithography. In the past, electron emission suitable for lithography has been obtained by applying an external magnetic field or heat. However, a conventional ferroelectric emitter cannot guarantee electron emission where the distance between two electrodes for applying a power is too wide or too narrow for switching.

For example, in the conventional ferroelectric emitter, if the distance between the two electrodes is too wide, then an electric field cannot reach the center portion of the ferroelectric emitter. Thus, a switching effect does not occur in a ferroelectric region. If, on the other hand, the distance between the two electrodes, or a gap of a mask pattern, is too narrow, then the mask pattern formed on a ferroelectric layer in a ferroelectric emitter absorbs electrons during electron emission, so that electrons flow through the patterned mask. Moreover, an isolated pattern, such as a doughnut shape, cannot be switched because the two electrodes are not connected to each other.

In contrast to ferroelectric switching, pyroelectric emission can provide a uniform emission of electrons regardless of the characteristics of a gap of a mask pattern. Pyroelectricity refers to the production of polarization changes by temperature variations. Due to such properties, when a material is subjected to a temperature change, the magnitude of a spontaneous polarization changes to affect bound charges, so that a current flows through electrodes.

If an emitter is heated and this process occurs in a vacuum, then bound charges, which are electrons screening on the surface of the emitter, are released in a vacuum, which is called pyroelectric emission. In this case, uniform emission is allowed whether a gap of the mask pattern is wide or narrow. Furthermore, pyroelectric emission enables electron emission in an isolated pattern such as a doughnut pattern. Although it facilitates electron emission, pyroelectric emission has several disadvantages. One of these disadvantages is the requirement of re-poling or heating the emitter above the Curie temperature for re-emission.

SUMMARY OF THE INVENTION

A feature of the present invention is to provide a ferroelectric emitter that allows electron emission in both wide and narrow gaps of a mask layer and in an isolated pattern such as a doughnut shape for ferroelectric switching emission lithography, while facilitating re-poling in pyroelectric emission.

The present invention provides a ferroelectric emitter including: a ferroelectric layer having a first side and an opposing second side and a top surface, a first electrode formed adjacent the first side and the top surface of the ferroelectric layer, a second electrode formed adjacent the opposing second side and the top surface of the ferroelectric layer; and a mask layer having a predetermined pattern and formed along the top surface of the ferroelectric layer between the first and second electrodes.

In a preferred embodiment of the present invention, the mask layer is formed by exposing a predetermined region of the top surface of the ferroelectric layer, and the orientation of the crystal lattice of a ferroelectric material of the ferroelectric layer is developed so as to form an acute angle with the direction of an electric field induced when a voltage is applied to the electrodes.

The present invention also provides a ferroelectric emitter including: a ferroelectric layer having a first side and an opposing second side and a top surface, a first electrode formed along the first side edge of the ferroelectric layer, a second electrode formed along the opposing second side edge of the ferroelectric layer, and a mask layer having a predetermined region and formed along the top surface of the ferroelectric layer.

In another preferred embodiment of the present invention, the mask layer is formed so as to expose a predetermined region of the top surface of the ferroelectric layer, and the orientation of the crystal lattice of a ferroelectric material of the ferroelectric layer is developed so as to form a predetermined angle with the direction of an electric field induced when a voltage is applied to the electrodes.

BRIEF DESCRIPTION OF THE DRAWINGS

The above-described features and advantages of the present invention will become more apparent by describing in detail a preferred embodiment of the present invention with reference to the attached drawings in which.

DETAILED DESCRIPTION OF PREFERRED EMBODIMENTS

Figure 1:
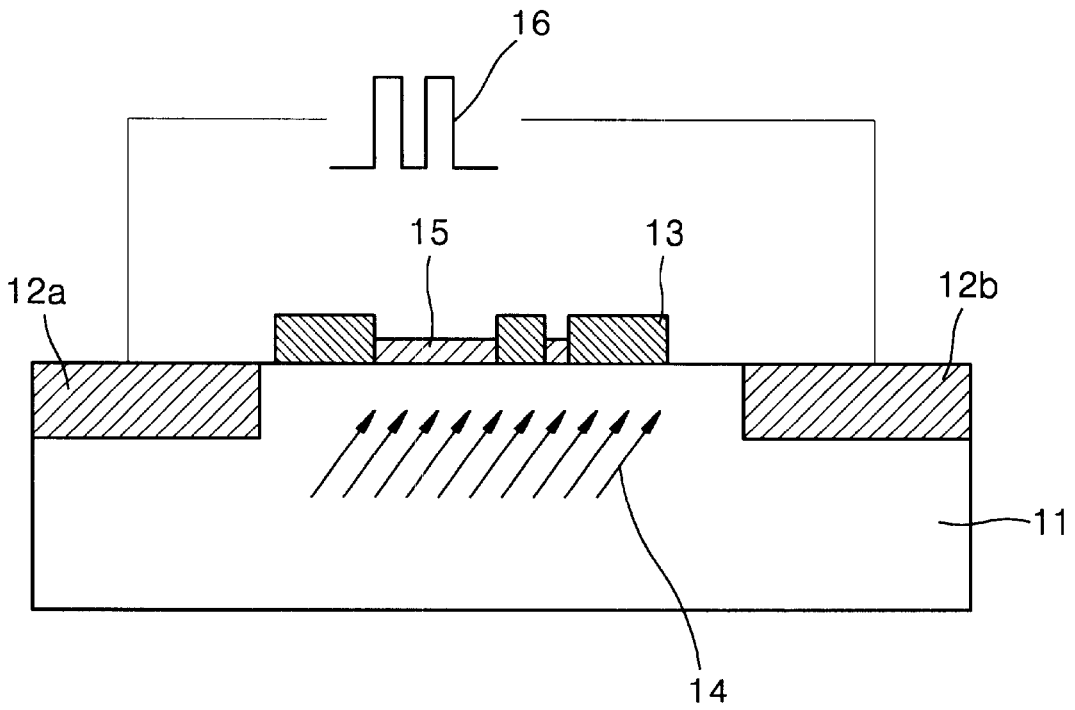
FIG. 1 is a cross-sectional view showing the structure of a ferroelectric emitter of the present invention having a first and a second electrode formed along the top surface and adjacent the first and second sides of a ferroelectric layer, respectively.

Referring to FIG. 1, an emitter according to the present invention includes a ferroelectric layer 11 comprised of a ferroelectric material, and a first electrode 12*a* and a second electrode 12*b* formed adjacent a first side and an opposing second side of the ferroelectric layer 11 along the top surface of the ferroelectric layer 11. Further, a mask layer 13 is formed between the first electrode 12*a* and second electrode 12*b* . The mask layer 13 is formed so as to expose a predetermined region of the top surface of the ferroelectric layer 11, which is an amount less than the entire top surface of the ferroelectric layer 11.

When a voltage is applied to the first electrode 12*a* and second electrode 12*b*, the ferroelectric layer 11 becomes polarized. The crystal lattice structure of a ferroelectric material forms a predetermined angle with the direction of an electric field to cause partial switching. Put another way, the ferroelectric layer 11 is formed so that the electrical field and the polarization 14 are produced in a horizontal direction and in an oblique direction, respectively, when a voltage is applied to the first electrode 12*a* and second electrode 12*b*.

The method of operation of the ferroelectric emitter according to the present invention will now be described. In order to collect electrons in a mask layer 13, a unipolar pulse 16 is applied to a first electrode 12*a* and a second electrode 12*b* so that the direction of polarization 14 is as shown in FIG. 1, considering the orientation of a ferroelectric material crystal lattice. For example, a positive voltage pulse 16 is shown in FIG. 1.

Figure 2:
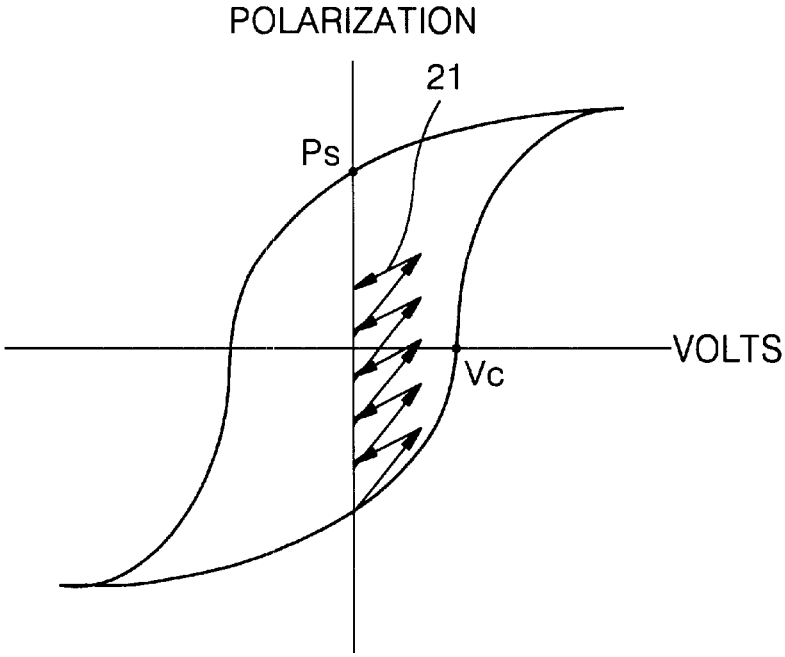
FIG. 2 is a graph of polarization vs. volts showing that the ferroelectric emitter according to the present invention reaches a maximum polarization value when the emitter continues partial switching.

In general, when a voltage is applied to both sides of the ferroelectric layer 11, partial switching occurs. Partial switching occurs when the applied voltage does not exceed a coercive voltage $V_c$, which is required for completely polarizing a ferroelectric material. However, as shown in FIG. 2, although the applied voltage does not go beyond the coercive voltage $V_c$, if the applied voltage is repeatedly applied to achieve partial switching, the polarization increases toward a maximum polarization value, Ps. When polarization occurs, screening charges 15, for compensating for the net electric dipole, are formed on the surface area of the ferroelectric layer 11. The screening charges 15 in FIG. 1 are electrons.

For electron emission in a ferroelectric emitter, electrons on the ferroelectric surface area, which are the screening charges, have to be emitted. In order for electrons to be emitted, the ferroelectric layer 11 of the present invention must be subjected to opposite switching or heating.

Figure 3:
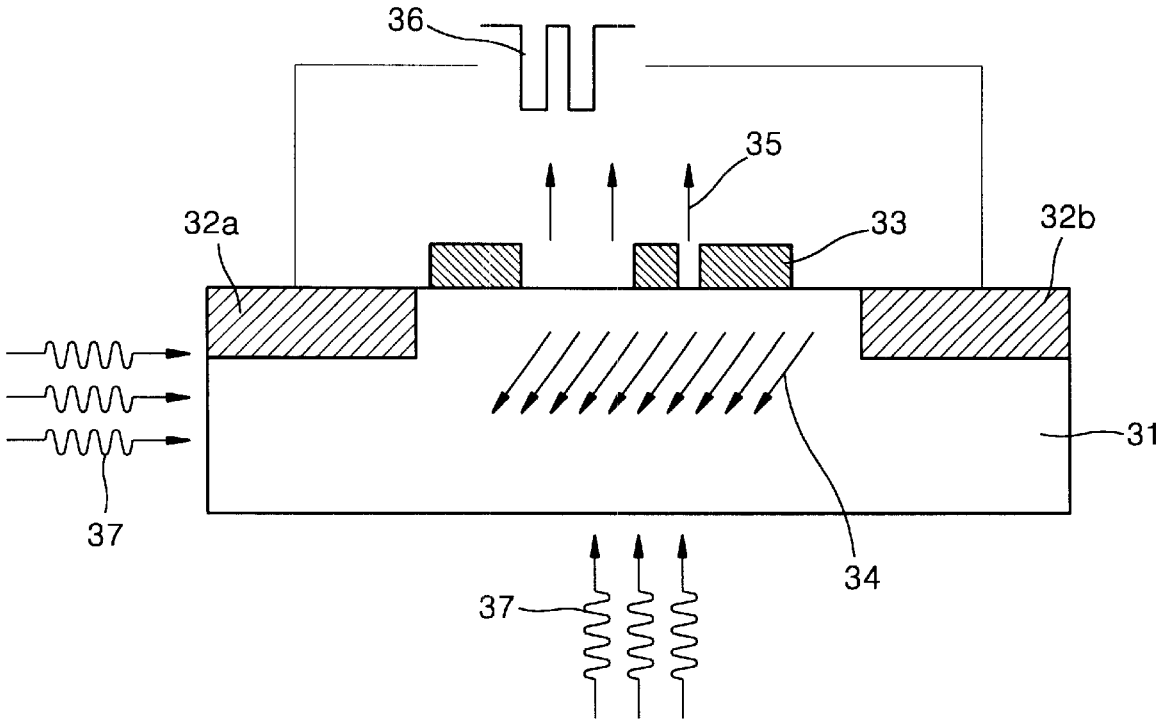
FIG. 3 is a cross-sectional view showing that pyroelectric emission is performed by applying heat to the ferroelectric emitter.

Referring now to FIG. 3, opposite switching for a ferroelectric layer 31 will be described. First, in order to emit screening charges 35 from between patterns of a mask layer 33 overlying the ferroelectric layer 31, a pulse 36 of opposite polarity to the previously applied unipolar pulse 16, discussed in connection with FIG.1, is continuously applied to the first and second electrodes 32*a* and 32*b*, respectively. In this case, screening charges 35, or electrons, between patterns of the mask layer 33 overlying the ferroelectric layer 31 are increasingly emitted from the mask layer 33 to a collector or electron resist, to which voltages of the first electrode 32*a* and second electrode 32*b* are applied, by the applied unipolar pulse 36.

Electron emission is gradually achieved by the repeatedly applied pulse 36, or as another electron emission method, heat 37, is applied to the ferroelectric emitter. Heating may be accomplished by a heater, laser, infrared rays, or the like, thereby allowing pyroelectric emission. Furthermore, the initial positive voltage pulse 16 is applied to perform screening on the electrons 35, which are positioned between patterns of the mask layer 33 overlying the ferroelectric layer 31 after electron emission.

Figure 4:
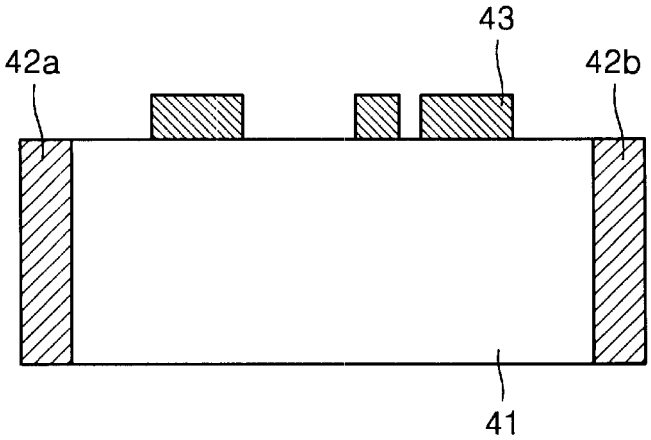
FIG. 4 is a cross-sectional view showing the structure of a ferroelectric emitter of the present invention having a first and a second electrode formed along the first and opposing second side edges of a ferroelectric layer, respectively.

Referring now to FIG. 4, another embodiment of the present invention will be described. In this embodiment, electrodes 42*a* and 42*b* are formed on two opposing sides of a ferroelectric layer 41, a first side and a second side. This embodiment includes the electrodes 42*a* and 42*b* formed on the first and second sides of the ferroelectric layer 41 and a mask layer 43 having a pattern formed on the ferroelectric layer 41. The mask layer 43 is formed so as to expose a predetermined region of the top of the ferroelectric layer 41, which is not the entire top surface of the ferroelectric layer 41. Therefore, a difference between the ferroelectric emitter of FIG. 1 and the ferroelectric emitter of FIG. 4 is in the region where electrodes are formed.

The method of operation of the ferroelectric emitter as shown in FIG. 4 is no different from the method of operation of the emitter as shown in FIG. 1. More specifically, a unipolar pulse is applied to the first electrode 42*a* and second electrode 42*b*, considering the orientation of a ferroelectric material crystal lattice so that electrons may be collected between patterns of the mask layer 43 formed on a top center portion of the ferroelectric layer 41. Then, if polarization occurs, screening charges are created on the surface area of the ferroelectric layer 41 to compensate for the electric dipole.

After the screening charges are created, a pulse of opposite polarity to that of the initially applied unipolar pulse is continuously applied in order to emit the screening charges produced between patterns of the mask layer 43 overlying the ferroelectric layer 41. In this embodiment, screening charges, which are electrons, positioned between patterns of the mask layer 43 overlying the ferroelectric layer 41 are gradually emitted from the mask layer 43 to a collector by the unipolar pulse. Furthermore, heat is applied to the ferroelectric emitter from the outside in order to enable pyroelectric emission. Additionally, to induce screening charges between patterns of the mask layer 43 overlying the ferroelectric layer 41 after electron emission, the initial pulse is applied to the first electrode 42*a* and second electrode 42*b* again.

The present invention allows electron emission in a wide or narrow region for ferroelectric emission lithography and in an isolated pattern such as a doughnut shape, while facilitating re-poling in pyroelectric emission. Accordingly, the present invention provides a ferroelectric emitter having many applications.

What is claimed is:

1. A ferroelectric emitter comprising:

a ferroelectric layer having a first side, an opposing second side and a top surface;

a first electrode formed at the top surface and adjacent to the first side of the ferroelectric layer;

a second electrode formed at the top surface and adjacent to the opposing second side of the ferroelectric layer;

a mask layer having a predetermined pattern is formed along the top surface of the ferroelectric layer between the first and second electrodes.

2. The ferroelectric emitter as claimed in claim 1, wherein the mask layer is formed by exposing a predetermined region of the top surface of the ferroelectric layer.

3. The ferroelectric emitter as claimed in claim 1, wherein the ferroelectric layer further comprises a crystal lattice having an orientation and a voltage being applied to the first and second electrodes and inducing an electric field having a direction; and the orientation of the crystal lattice of a ferroelectric material of the ferroelectric layer is developed so as to form an acute angle with the direction of the electric field induced when the voltage is applied to the electrodes.

4. A ferroelectric emitter comprising:

a ferroelectric layer having a first side edge, an opposing second side edge, and a top surface;

a first electrode formed along the first side edge of the ferroelectric layer;

a second electrode formed along the opposing second side edge of the ferroelectric layer; and a mask layer having a predetermined region is formed along the top surface of the ferroelectric layer between the first and second electrodes.

5. The ferroelectric emitter as claimed in claim 4, wherein the mask layer is formed so as to expose a predetermined region of the top surface of the ferroelectric layer.

6. The ferroelectric emitter as claimed in claim 4, wherein the ferroelectric layer further comprises a crystal lattice having an orientation and a voltage being applied to the first and second electrodes and inducing an electric field having a direction; and the orientation of the crystal lattice of a ferroelectric material of the ferroelectric layer is developed so as to form a predetermined angle with the direction of the electric field induced when the voltage is applied to the electrodes.

* * * * *